US007922072B2

(12) United States Patent
Hassenzahl

(10) Patent No.: US 7,922,072 B2
(45) Date of Patent: Apr. 12, 2011

(54) SELF-SERVICE CHECKOUT SYSTEM WITH CASH NOT AVAILABLE MODE

(75) Inventor: Steven L. Hassenzahl, Snellville, GA (US)

(73) Assignee: NCR Corporation, Duluth, GA (US)

( * ) Notice: Subject to any disclaimer, the term of this patent is extended or adjusted under 35 U.S.C. 154(b) by 696 days.

(21) Appl. No.: 11/830,229

(22) Filed: Jul. 30, 2007

(65) Prior Publication Data

US 2009/0032588 A1 Feb. 5, 2009

(51) Int. Cl.
*G07G 1/00* (2006.01)

(52) U.S. Cl. ..... 235/7 A; 235/7 R; 235/23; 235/375; 221/8; 221/17; 222/23

(58) Field of Classification Search ..... 221/6–8, 221/17, 18; 222/23
See application file for complete search history.

(56) References Cited

U.S. PATENT DOCUMENTS

| | | | | |
|---|---|---|---|---|
| 4,499,982 | A * | 2/1985 | Sugimoto et al. | 194/217 |
| 5,071,127 | A * | 12/1991 | Bromley et al. | 273/108.1 |
| 5,987,439 | A * | 11/1999 | Gustin et al. | 235/379 |
| 5,992,570 | A | 11/1999 | Walter | |
| 6,213,395 | B1 | 4/2001 | Dejaeger et al. | |
| 6,505,774 | B1 * | 1/2003 | Fulcher et al. | 235/381 |
| 6,994,202 | B1 * | 2/2006 | Billington et al. | 194/217 |
| 2002/0037696 | A1 * | 3/2002 | Fletcher | 453/1 |
| 2002/0138446 | A1 * | 9/2002 | Antonin et al. | 705/67 |
| 2004/0069848 | A1 | 4/2004 | Persky | |
| 2006/0219516 | A1 * | 10/2006 | Saltsov et al. | 194/207 |

FOREIGN PATENT DOCUMENTS

WO WO 03/083787 10/2003

* cited by examiner

*Primary Examiner* — Thien M. Le
*Assistant Examiner* — Christle I Marshall
(74) *Attorney, Agent, or Firm* — Paul W. Martin; Robert S. Chee

(57) ABSTRACT

A self-service checkout system which continues operation when cash transaction options are not available. The self-service checkout system includes a cash dispenser, a display for displaying payment options, an input device for recording selection of payment options, including cash and non-cash transaction options, and a processor for disabling the cash transaction options when an amount of cash in the cash dispenser falls below a predetermined limit, but for otherwise continuing operation by allowing the non-cash transaction options.

26 Claims, 3 Drawing Sheets

SELF-SERVICE CHECKOUT SYSTEM WITH CASH NOT AVAILABLE MODE

BACKGROUND

Self-service checkout systems accommodate many forms of payment. A failure of one of these forms of payment often results in the systems being taken out of service.

It would be desirable to provide a self-service checkout system that may still operate if a form of payment is unavailable.

SUMMARY

A self-service checkout system with cash not available mode is provided.

The self-service checkout system includes.

DETAILED DESCRIPTION

Figure 1:
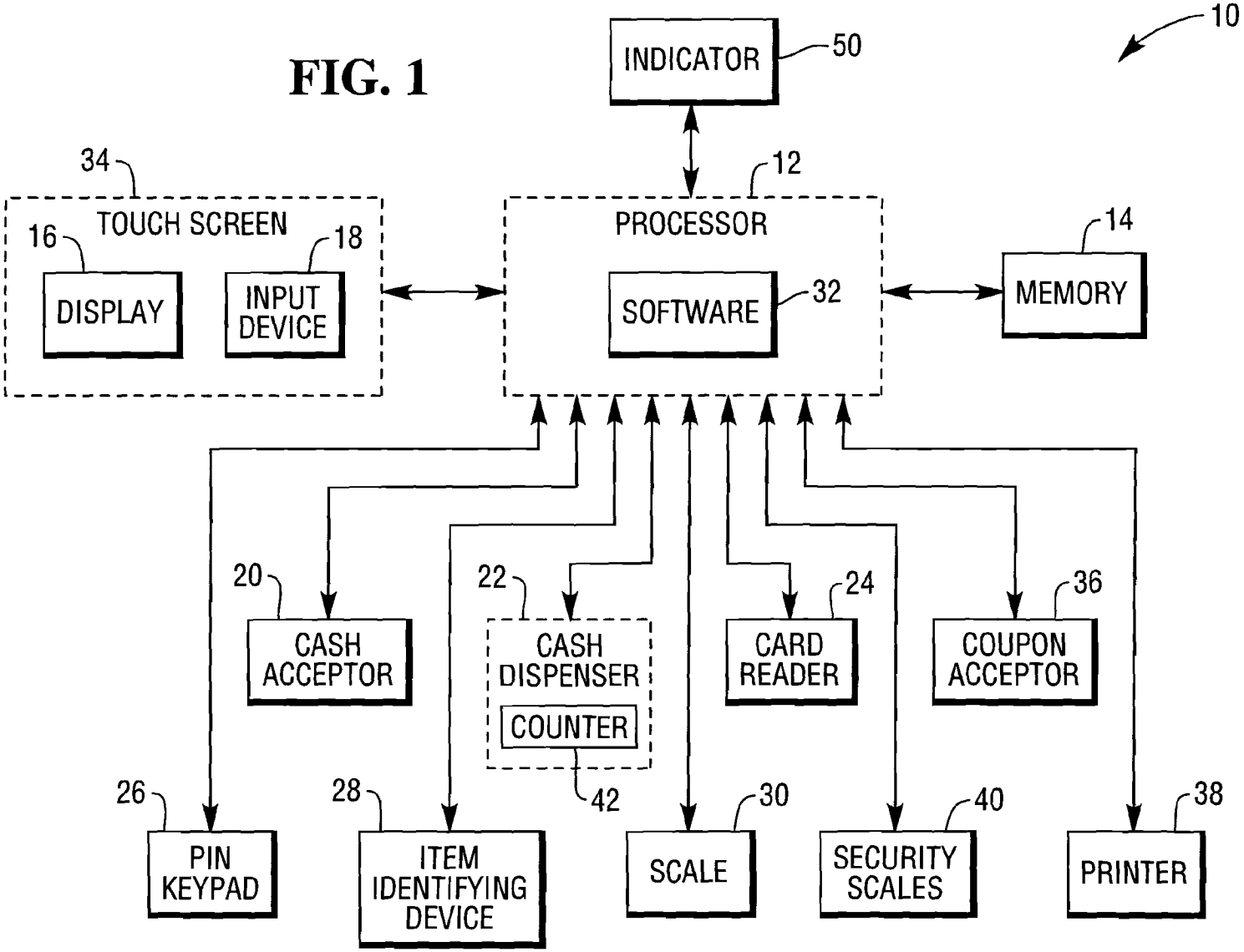
FIG. 1 is a block diagram of a self-service checkout system.

Referring now to FIG. 1, self-service checkout system 10 primarily includes processor 12, memory 14, display 16, input device 18, cash acceptor 20, cash dispenser 22, card reader 24, personal identification number (PIN) keypad 26, item identifying device 28, scale 30, coupon acceptor 36, and printer 38.

Processor 12 executes software 32 for controlling operation of self-service checkout system 10. Processor 12 uses memory 14 to store software 32.

One of the functions of software 32 is to monitor the state of system 10 for limiting conditions, including component failures and a lack of cash in cash dispenser 22.

Cash dispenser 22 dispenses cash to customers, usually in the form of change or additional cash back. Cash dispenser 22 may include a coin dispenser and a bill dispenser, which may be separate devices. The coin dispenser and bill dispenser each have a limited capacity for storing coins and bills for making change and delivering additional cash back.

Software 32 determines that cash dispenser 22 has a lack of cash by tracking cash dispensed and comparing it to a predetermined limit. Software 32 counts the value of cash dispensed during each transaction as change or as additional cash back. Software 32 may additionally count the number of each denomination of cash dispensed during each transaction.

Software 32 may maintain individual balances and limits for bill and coin dispensers. Software 32 may maintain individual numbers or balances for each denomination of bills and coins. The predetermined limit may be based upon any one of the denominations.

The predetermined limit may be determined manually. A store employee manually counts an amount of cash loaded into cash dispenser 22 and configures software 32 with the loaded amount. Software 32 adds the loaded amount to a pre-existing amount within cash dispenser 22 to arrive at a new balance. The employee also configures software 32 with a minimum cash amount, which when reached will cause software 32 to disable a cash payment option and an additional cash back option. Alternatively, the minimum cash amount may remain the same after each load. Software 32 maintains a running balance of cash within cash dispenser 22 by tracking amounts of change and additional cash back given to each customer and subtracting those amounts from a balance remaining after a previous transaction.

In an alternative embodiment, cash dispenser 22 includes coin counter 42. An employee feeds or pours bills and coins into cash dispenser 22 and counter 42 counts the bills and coins added and provides software 32 with numbers and amounts of bills and coins.

Display 16 displays instructions and information provided by software 32. For example, display 16 displays payment options including cash and non-cash payment options. Non-cash payment options include, but are not limited to, credit, debit, smart card, gift card, stamps, and vouchers.

Input device 18 records operator inputs processed by software 32. Input device 18 may include a keyboard. Input device 18 and display 16 may be combined into a touch screen 34.

Cash acceptor 20 accepts cash payments from customers. Cash acceptor 20 may include a coin acceptor and a bill acceptor, which may be separate devices.

Card reader 24 reads information from cards, such as credit and debit cards. Card reader 24 may include a magnetic strip reader.

PIN keypad 26 records customer PINs during debit card transactions.

Item identifying device 28 records information from products. Item identifying device 28 may include a barcode reader or a radio frequency label identification reader.

Scale 30 records weights of certain items, such as produce items.

Coupon acceptor 36 accepts coupons from customers.

Printer 38 prints transaction documents, including receipts.

Self-service checkout system 10 may additionally includes security systems, which may include a number of security scales 40.

Security scales 40 determine whether unidentified products have been substituted for identified products of lesser value. Security scales 40 may be located under set-aside shelves and bagging shelves.

In accordance with an example of the present invention, self-service checkout system 10 further includes indicator 50, which provides an indication of payment limitations in the operation of system 10 to customers under the control of software 32. For example, indicator 50 may indicate that only credit payments are allowed by displaying the message, "CREDIT ONLY".

In a simplified form, indicator 50 may include a sign for displaying a single message, with apertures representing letters, and a light for illuminating the sign through the apertures. Software 32 activates indicator 50 by activating the light.

In other embodiments in which a plurality of messages are displayed, indicator 50 may include a display, such as a liquid crystal display. Software 32 activates indicator 50 by choosing a message based upon limiting conditions monitored by software 32 and displaying the message.

Figure 2:
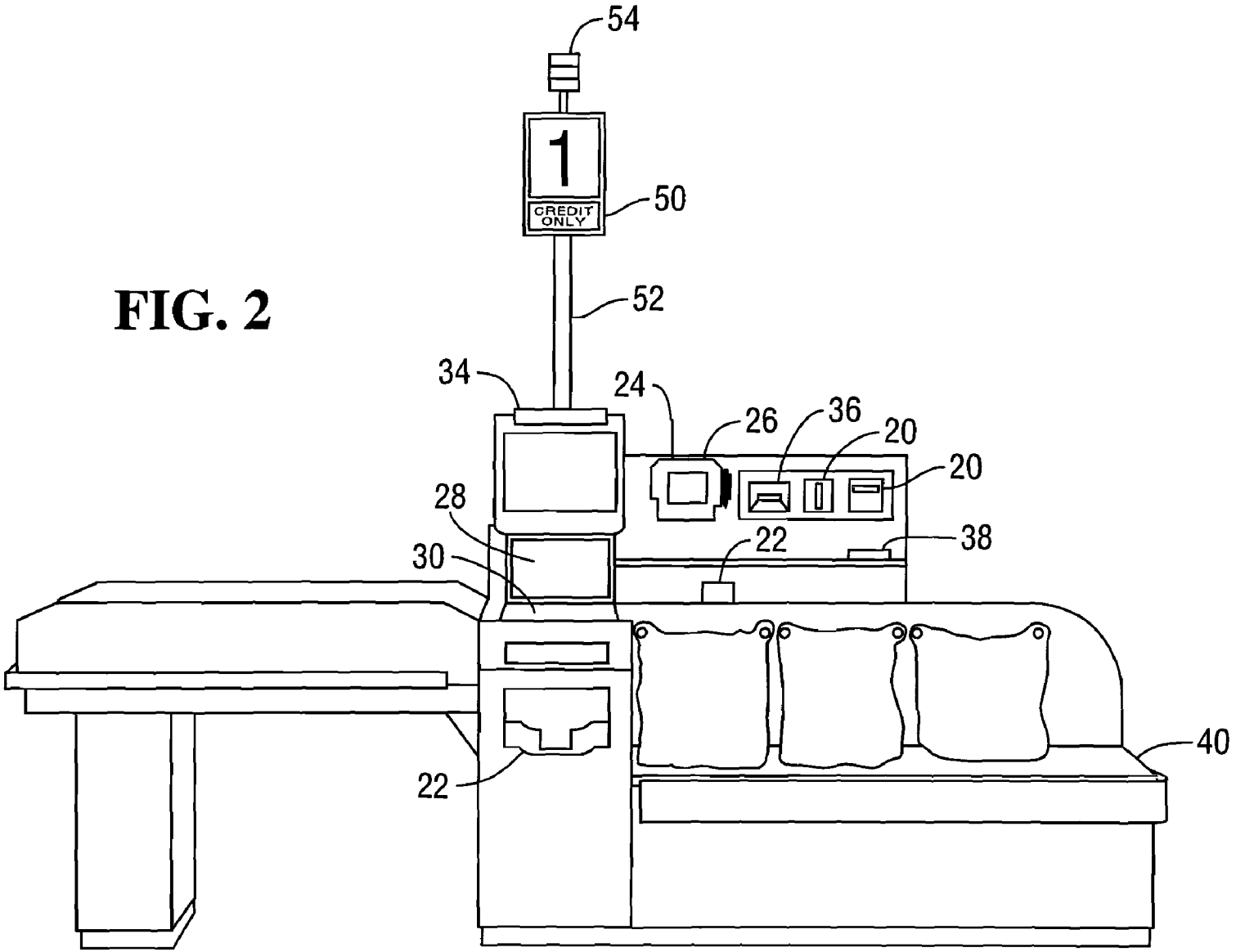
FIG. 2 is a view illustrating an example self-service checkout system.

With reference to FIG. 2, an example embodiment of system 10 is illustrated. Indicator 50 is mounted to pole 52. In addition to indicator 50, pole 52 supports one or more lane lights 54. Light 54 may provide a further indication of that system 10 is limited in operation.

Figure 3:
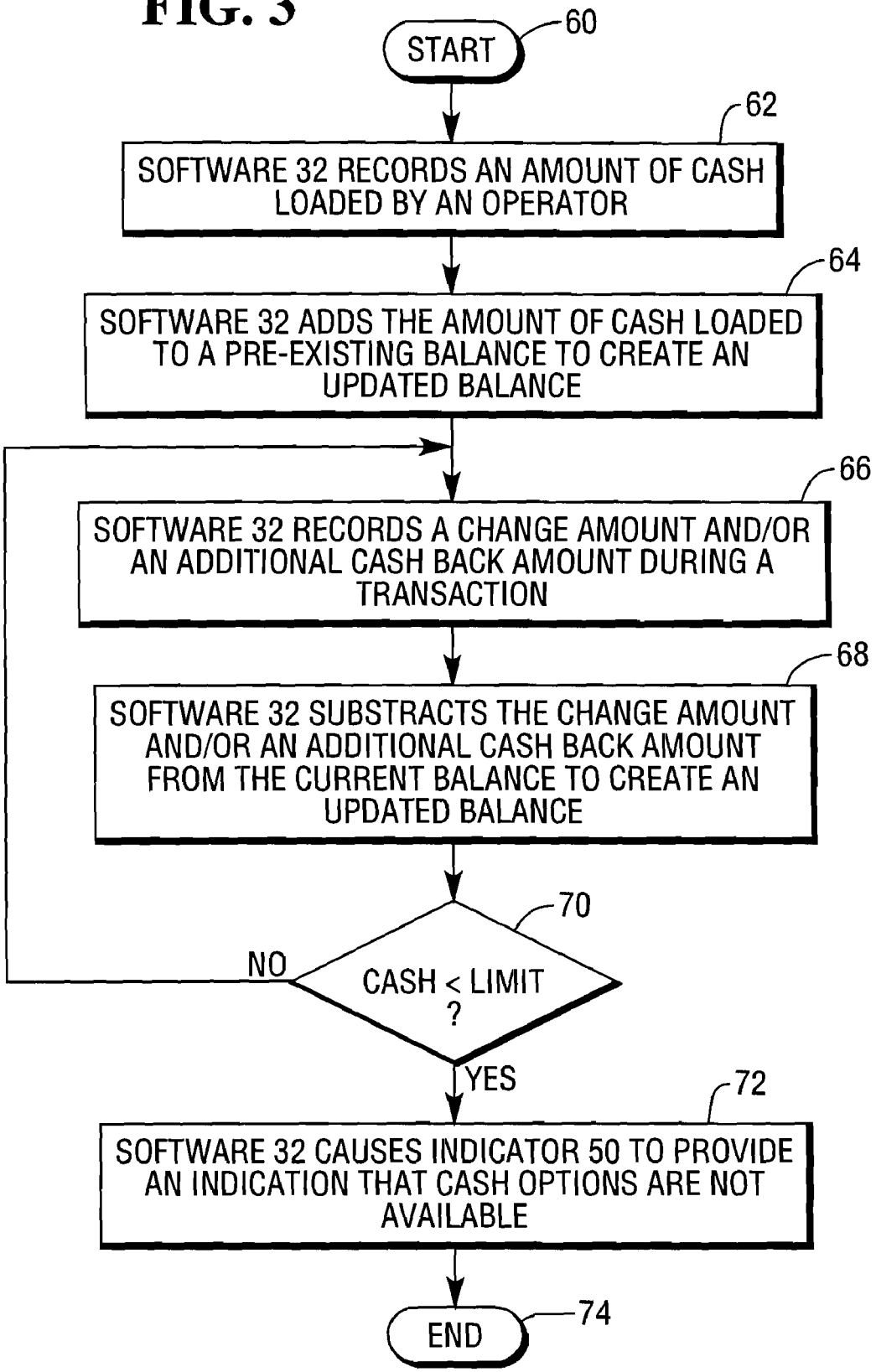
FIG. 3 is flow diagram illustrating a method of operation of the self-service checkout system.

With reference to FIG. 3, an example method of operation of system 10 is illustrated in detail beginning with START 60.

In step 62, software 32 records an amount of cash loaded by an operator. Software 32 may record separate amounts of bills and coins. Software 32 may record individual amounts for each denomination of bills and coins.

In step 64, software 32 adds the amount of cash loaded to a pre-existing balance to create an updated balance. Software 32 may maintain individual balances for bill and coin dispensers. Software 32 may maintain individual balances for each denomination of bills or coins.

In step 66, software 32 records a change amount and/or an additional cash back amount during a transaction.

In step 68, software 32 subtracts the change amount and/or an additional cash back amount from the current balance to create an updated balance.

In step 70, software 32 determines whether the updated balance is below a predetermined limit. The bill and coin dispensers may have different limits, either of which will cause software 32 to disable cash transactions. The predetermined limit may be based upon any one of the denominations of bills or coins. If so, operation returns to step 72. Otherwise, operation returns to step 66.

In step 72, software 32 causes indicator 50 to provide an indication that cash payments are not allowed. For example, software 32 may cause indicator 50 to provide an indication that only non-cash payment options are allowed, including, but not limited to, credit, debit, smart card, gift card, stamps, and vouchers.

Indicator 50 may also provide an indication that the additional cash back option is not available.

Software 32 may disable selection of a cash payment and additional cash back options. Software 32 may display choices for cash transaction options in a faded or "grayed out" manner, and/or disable recording of selections through touch screen 34. Software 32 may additionally activate light 54 to provide an additional visual indication that cash options are not available.

Operation ends at step 74. Except for cash dispensing, operation of system 10 continues in a normal fashion.

Although particular reference has been made to certain embodiments, variations and modifications are also envisioned within the spirit and scope of the following claims.

The invention claimed is:

1. A self-service checkout system comprising:

a cash dispenser comprising an amount of cash;

a display for displaying payment options;

an input device for recording selection of payment options, including cash and non-cash transaction options; and a processor for disabling the cash transaction options when the amount of cash in the cash dispenser falls below a predetermined limit by disabling selection of any cash transaction option on the input device and removing the display of all cash transaction payment options on the display, but continuing operation by allowing the non-cash transaction options.

2. The system of claim 1, wherein the processor disables the cash transaction options when a number of a denomination of the cash falls below a corresponding predetermined limit.

3. The system of claim 1, wherein the cash dispenser further comprises:

a bill dispenser;

wherein the processor disables the cash transaction options when a value of bills within the bill dispenser falls below the predetermined limit.

4. The system of claim 1, wherein the cash dispenser further comprises:

a coin dispenser;

wherein the processor disables the cash transaction options when a value of coins within the coin dispenser falls below the predetermined limit.

5. The system of claim 1, wherein the cash dispenser further comprises:

a bill dispenser; and a coin dispenser;

wherein the processor disables the cash transaction options when either a first value of bills within the bill dispenser falls below a first predetermined limit or a second value of coins within the coin dispenser falls below a second predetermined limit.

6. The system of claim 1, wherein the processor records an amount of cash loaded into the cash dispenser, adds the amount of cash loaded to a pre-existing balance to create an updated balance in the cash dispenser, subtracts dispensed cash from the updated balance to create a running balance, and compares the running balance to the predetermined limit following each transaction.

7. The system of claim 6, wherein the processor records entry of the amount of cash loaded via the input device.

8. The system of claim 6, wherein the cash dispenser includes a counter, and wherein the processor obtains the amount of cash loaded from the counter.

9. The system of claim 6, wherein dispensed cash comprises change.

10. The system of claim 6, wherein dispensed cash comprises additional cash back.

11. The system of claim 6, wherein the processor maintains individual numbers for each denomination of cash, compares each of the denominations to corresponding predetermined limits, and disables the cash transaction options when any of the denominations of cash falls below the corresponding predetermined limit.

12. The system of claim 1, wherein the processor causes the display of selections for the cash transaction options in a faded manner when cash transaction options are disabled.

13. The system of claim 1, further comprising an indicator activated by the processor for providing an indication to operators of the self-service checkout system that the cash transaction options are not available.

14. The system of claim 13, wherein the indicator comprises a lane light.

15. A self-service checkout method comprising:

determining an amount of cash in a cash dispenser by a self-service checkout computer;

disabling cash transaction options when the amount of cash in the cash dispenser falls below a predetermined limit by the self-service checkout computer by disabling any selection of a cash transaction option and removing the display of all cash transaction payment options on the display; and continuing operation by allowing non-cash transaction options by the self-service checkout computer.

16. The method of claim 15, wherein the disabling step comprises:

disabling the cash transaction options when a number of a denomination of the cash falls below a corresponding predetermined limit.

17. The method of claim 15, wherein the cash dispenser comprises a bill dispenser, and wherein the disabling step comprises disabling cash transaction options when a value of bills within the bill dispenser falls below the predetermined limit.

18. The method of claim 15, wherein the cash dispenser comprises a coin dispenser, and wherein the disabling step comprises disabling cash transaction options when a value of coins within the coin dispenser falls below the predetermined limit.

19. The method of claim 15, wherein the cash dispenser comprises a bill dispenser and a coin dispenser, and wherein the disabling step comprises disabling cash transaction options when either a first value of bills within the bill dispenser falls below a first predetermined limit or a second value of coins within the coin dispenser falls below a second predetermined limit.

20. The method of claim 15, wherein the determining step comprises:

recording an amount of cash loaded into the cash dispenser by the self-service checkout computer;

adding the amount of cash loaded to a pre-existing balance to create an updated balance in the cash dispenser by the self-service checkout computer;

subtracting dispensed cash from the updated balance to create a running balance by the self-service checkout computer; and comparing the running balance to the predetermined limit following each transaction by the self-service checkout computer.

21. The method of claim 20, wherein the recording step comprises:

recording entry of the amount of cash loaded via an input device of the self-service checkout computer.

22. The method of claim 20, wherein the recording step comprises:

obtaining the amount of cash loaded from a counter in the cash dispenser.

23. The method of claim 15, wherein dispensed cash comprises change.

24. The method of claim 15, wherein dispensed cash comprises additional cash back.

25. The method of claim 15, wherein the disabling step further comprises: displaying choices for the cash transaction options in a faded manner.

26. The method of claim 15, further comprising:

activating a lane light by the self-service checkout computer to indicate to operators that the cash transaction options are not available.

* * * * *